US007802402B2

(12) United States Patent
Skaggs

(10) Patent No.: US 7,802,402 B2
(45) Date of Patent: Sep. 28, 2010

(54) CRAWL SPACE ACCESS DEVICE

(75) Inventor: Albert Skaggs, Seymour, IN (US)

(73) Assignee: Turtl Enterprises LLC, Seymour, IN (US)

( * ) Notice: Subject to any disclaimer, the term of this patent is extended or adjusted under 35 U.S.C. 154(b) by 0 days.

(21) Appl. No.: 11/861,218

(22) Filed: Sep. 25, 2007

(65) Prior Publication Data

US 2008/0072502 A1 Mar. 27, 2008

Related U.S. Application Data

(60) Provisional application No. 60/847,265, filed on Sep. 26, 2006, provisional application No. 60/886,028, filed on Jan. 22, 2007.

(51) Int. Cl.
*E02D 29/14* (2006.01)

(52) U.S. Cl. ..... 52/20; 52/107; 52/169.6

(58) Field of Classification Search ..... 52/19, 52/20, 107, 21; 49/367; D25/54
See application file for complete search history.

(56) References Cited

U.S. PATENT DOCUMENTS

| | | | | | |
|---|---|---|---|---|---|
| 1,840,397 | A | * | 1/1932 | Keyes | 52/107 |
| 2,237,564 | A | * | 4/1941 | Keyes | 52/107 |
| 2,332,641 | A | * | 10/1943 | Jahant | 285/407 |
| 2,883,853 | A | * | 4/1959 | Forni | 52/21 |
| D242,924 | S | | 1/1977 | McKnight | |
| D245,102 | S | | 7/1977 | Gross | |
| 4,704,828 | A | | 11/1987 | Kemp | |
| 5,103,872 | A | * | 4/1992 | Jyh-Long | 138/158 |
| 5,253,901 | A | * | 10/1993 | Hunter | 285/424 |
| 5,327,682 | A | | 7/1994 | Holtz | |
| 5,386,669 | A | * | 2/1995 | Almeida | 52/19 |
| 5,600,921 | A | * | 2/1997 | Vardaro | 49/380 |
| 5,617,679 | A | * | 4/1997 | Meyers | 52/20 |
| 6,151,848 | A | | 11/2000 | Hunter | |
| 6,260,312 | B1 | * | 7/2001 | Spene et al. | 52/169.6 |
| 6,385,913 | B1 | * | 5/2002 | Ahn | 52/20 |
| 6,550,207 | B1 | | 4/2003 | Pontarolo | |
| D478,672 | S | | 8/2003 | Charlebois | |
| D486,582 | S | | 2/2004 | Hawkes | |
| 6,749,363 | B1 | * | 6/2004 | Petersen | 404/25 |
| 6,810,629 | B1 | | 11/2004 | Hughes | |
| D502,147 | S | * | 2/2005 | Stahl, Sr. | D13/155 |
| 6,877,281 | B1 | * | 4/2005 | Gavin | 52/19 |
| 6,901,969 | B2 | * | 6/2005 | Siiter | 138/172 |
| 7,040,979 | B1 | | 5/2006 | Betz | |
| 2003/0097802 | A1 | | 5/2003 | Kim et al. | |
| 2005/0266791 | A1 | | 12/2005 | Beliveau et al. | |

* cited by examiner

*Primary Examiner*—Richard E Chilcot, Jr.
*Assistant Examiner*—William V Gilbert
(74) *Attorney, Agent, or Firm*—E. Victor Indiano

(57) ABSTRACT

A crawl space access device is capable of being placed in a below grade level crawl space entry pit, and mating with the below grade opening in a building wall. The crawl space access device includes a body member having a base portion restable on a horizontal surface of the pit. A side wall portion extends generally perpendicular to the base portion. The side wall portion includes a side wall opening matable with the below grade opening.

22 Claims, 8 Drawing Sheets

CRAWL SPACE ACCESS DEVICE

I. CLAIM OF PRIORITY

This application claims benefit to Albert Skaggs, U.S. Provisional Patent Application Ser. No. 60/847,265, entitled CRAWL SPACE ACCESS DEVICE, that was filed on 26 Sep. 2006, and Albert Skaggs, U.S. Provisional Patent Application No. 60/886,028 filed 22 Jan. 2007, entitled CRAWL SPACE ACCESS DEVICE.

TECHNICAL FIELD OF THE INVENTION

The present invention relates to devices for use on buildings, and more particularly to a device for use on a building that helps to provide access to a space under a building, such as a crawl space.

II. BACKGROUND OF THE INVENTION

Currently, about 20% of American houses are constructed by being built on a crawl space. To build a crawl space, a hole (pit) is excavated that is generally similar but slightly larger in size and configuration to the foot print of the house that will be built over the crawl space. For a typical crawl space, the pit is typically dug to a depth of 2½ to 3 feet. Once this pit is dug, a vertical crawl space wall is built that is generally identical in size and configuration to the outer perimetral wall of the house. This crawl space wall is usually constructed either by forming a concrete block wall, or a poured concrete wall.

The floor of the first story of the house is then built over the concrete wall, so that a space exists between the underside of the first floor of the house and the upper surface of the bottom of the pit that is surrounded by the crawl space wall. This space is referred to as a crawl space. In most cases, a layer of pea gravel is placed on the crawl space floor.

It is important to have some way to gain access to this crawl space. Access is important, because most houses have a large amount of HVAC, plumbing, and electrical components, such as drain pipes, electrical conduits, HVAC ducts, telephone wires, fresh water pipes and the like that run in the crawl space, so that utilities, such as electricity and running water can be provided to the different rooms in the house.

There are several ways to provide this access to the crawl space. One way to provide this access is to provide a trap door in the floor of one of the rooms or closets of the house.

Probably the most common way to provide access to this crawl space is to provide an opening in the vertical crawl space wall through which the user can pass from the exterior of the house into the crawl space to gain access to the crawl space. Often, a door is provided that fits in the opening to normally close-off the opening to prevent animals and other undesirable creatures from entering into the crawl space, and also to prevent cold or warm air (depending on the season) from filling the crawl space and thus adding to the utility bills of the user.

Most crawl space doors comprise generally planar sheets of metal having a pivotably mounted handle member. The door is fit into a sill that extends around the opening of the crawl space wall, and the door handle member is capable of pivoting between an "unlocked" position where it does not engage the sill, and a locked position where a portion of the handle engages the sill to maintain the door in its position on the sill in a "door closed" position.

From a builder's perspective, providing these crawl space access structures results in several significant issues with which one must deal. The most significant issue is that most, and usually all of the crawl space wall in a finished house is usually disposed below the level of grade, and hence is underground. As such, one must dig a pit adjacent to the crawl space opening to permit the user to descend into the pit vertically, so that the user can then proceed laterally through the opening in the crawl space wall to enter the crawl space. Digging such a pit presents problems because the walls of the pit must be shored up, for without being shored up, a collapse may occur.

Another issue is that constructing a crawl space pit is a very time-consuming process for the builder. First, the user must excavate the pit. After this is done, the builder must then generally insert a layer of pea gravel over the base of the pit to a desired thickness level.

After this is finished, the builder must then build a support wall. Traditionally, support walls are built by forming a concrete block wall against the edges of the pit, to prevent the hole from collapsing. A less expensive alternate method is to provide a corrugated half-pipe that serves as the pit wall.

When the support wall is created, the retaining sill for the crawl space opening must then be affixed to the concrete wall to provide a frame for receiving a door. Finally, the door must be installed.

After the concrete block or corrugated half-pipe pit wall is built, and the door is installed, a row of cap material is usually placed along the top of the wall. This row of cap material often comprises brick that is the same brick from which the house is made, so that the crawl space entrance will be more aesthetically pleasing. Finally, a cap can be placed over the top of the crawl space pit wall to form a cover for the access pit. Typically, this pit cover is made from pressure treated wood.

Although the process for making such a crawl space entry pit has been described, it actually comprises somewhere between a 13 and 15 step process. The cost of creating this pit is often in the $300 to $500.00 range. A further difficulty is that different steps of the construction of the access occur at spaced, intermittent intervals during the entire period of the construction of the house, thus forcing workers to build one phase, stop work on it, then later start a second phase, stop work on it, and then do a third phase, etc. Generally, constructing the crawl space pit entry begins during the excavation of the house, and is not finished completely until the final punch list inspection of the house that occurs just before the completed house is turned over to the buyer.

As such, creating a crawl space pit requires a significant coordination effort between the builder and the various masons, excavators, concrete persons, carpenters and other craftsmen involved in the construction process.

Further difficulties exist with respect to the way the device actually operates during the life span of the house. Crawl space access pits constructed according to the current construction techniques, usually still permit water and moisture to get inside the pit, even when a cap is employed to keep rain and moisture out of the pit. Additionally, the metals used for the door and metal sill have a tendency to rust. Once the metal door and sill rust, there is no easy way to remove them and replace them with non-rusted components. As such, over time the aesthetic appeal of the door, sill and concrete block member deteriorate significantly, thus detracting from the aesthetic appeal of the house.

One object of the present invention is to provide a more cost-effective crawl space access system that will facilitate ease of construction, and will have increased durability, when compared to known prior art devices.

III. SUMMARY OF THE INVENTION

In accordance with the present invention, a crawl space access device is capable of being placed in a below grade level crawl space entry pit, and mating with a below grade opening in a building wall. The crawl space access device comprises a body member having a base portion restable on a horizontal surface of the pit and a side wall portion. The side wall portion extends generally perpendicular to the base portion. The side wall portion includes a side wall opening mateable with the below grade opening.

Preferably, the side wall portion includes a first side wall panel, and a second side wall panel disposed in a parallel relation with the first side wall panel, and placed in an opposed relation thereto. A first end panel wall is disposed in a plane generally perpendicular to the plane in which the first and second end panel walls reside. The first end panel wall generally extends between the first and second side panel walls.

The opening is disposed opposite to the end panel, and adjacent to the first and second side panel walls. In a preferred embodiment, a pair of side flanges extend perpendicular to the side wall. Fasteners, such as bolts or screws can extend through the flange members to secure the base member to the wall of the crawl space.

The second ends of the side panel and floor include a portion that extends through the below grade opening of the building wall. Fasteners, such as bolts, can be extended through these side members to further secure the base member of the crawl access unit to the wall of the crawl space.

Preferably, the device is made from plastic, and has a double-wall construction with a hollow interior. The side walls of the device will generally have a hollow interior that can be filled with foam for insulation, or a ballast material such as sand for adding additional weight and structural strength. Preferably, the device is made through a rotation molding process from polyethylene plastic, or other suitable plastic.

In a most preferred embodiment of the present invention, the floor of the tub portion is formed to include a removable sump hole cover. The sump hole cover is provided for enabling a user to gain access to a sump pump that can be placed beneath the crawl access device of the present invention. A sump pump so placed is provided for removing accumulated water that may build up either in the crawl space of the home, or in the area adjacent to the outer walls of the home and beneath the crawl space access device.

Other features and advantages of the present invention will be understood with reference to the drawings and detailed description set forth below that present the best mode of practicing the Applicant's invention perceived at the present time.

IV. BRIEF DESCRIPTION OF THE DRAWINGS

V. DETAILED DESCRIPTION OF THE INVENTION

Figure 1:
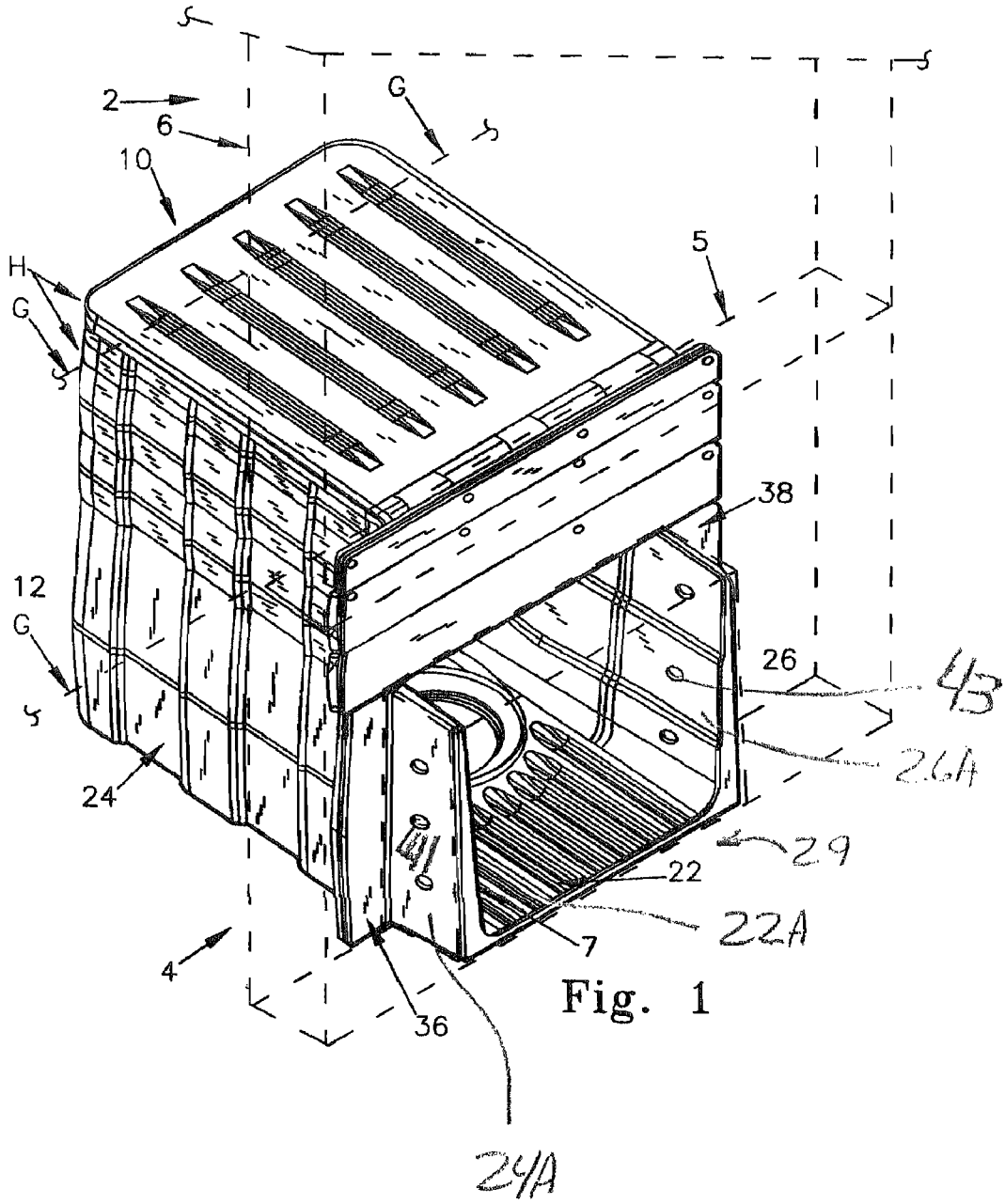
FIG. 1 is a perspective view of the assembled device of the present invention, showing in phantom a crawl space wall to which the device is attached and fastened.
Figure 1A:
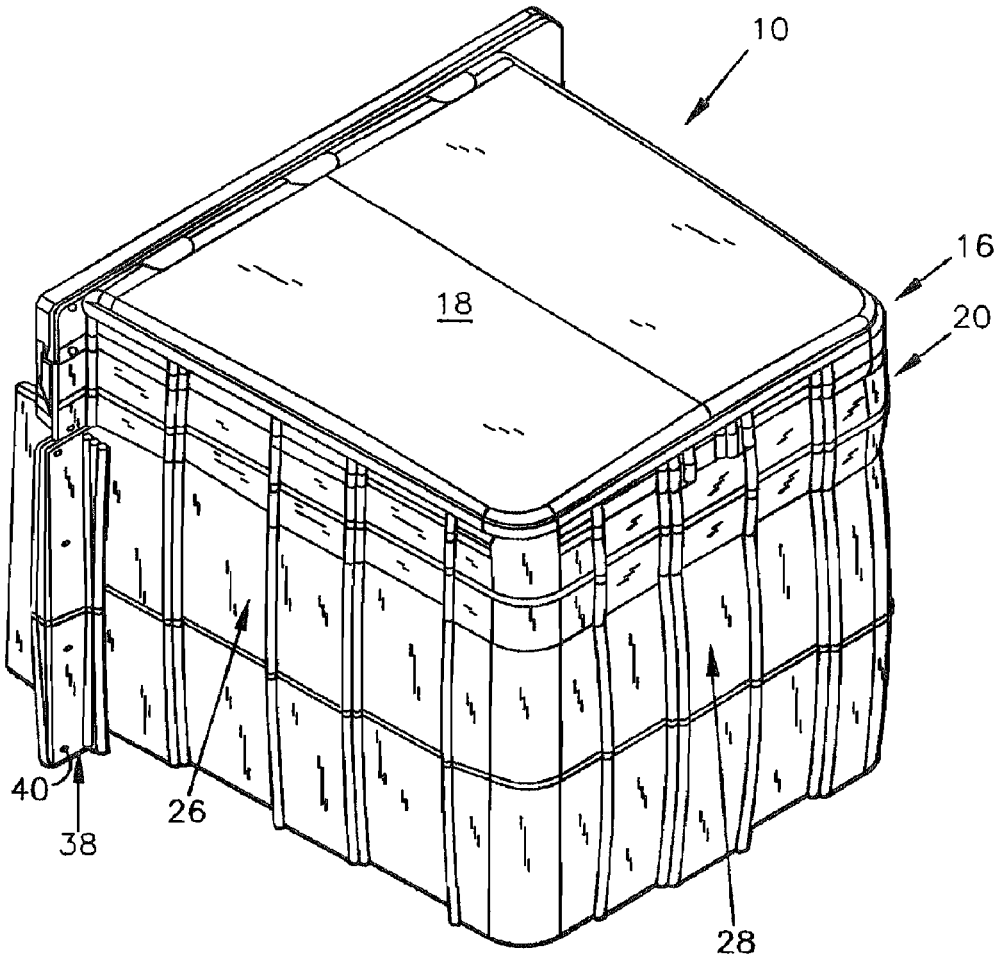
FIG. 1A is a perspective view of the device (without the wall), similar to FIG. 1, except showing the closed end of the tub-like crawl space access device.
Figure 2:
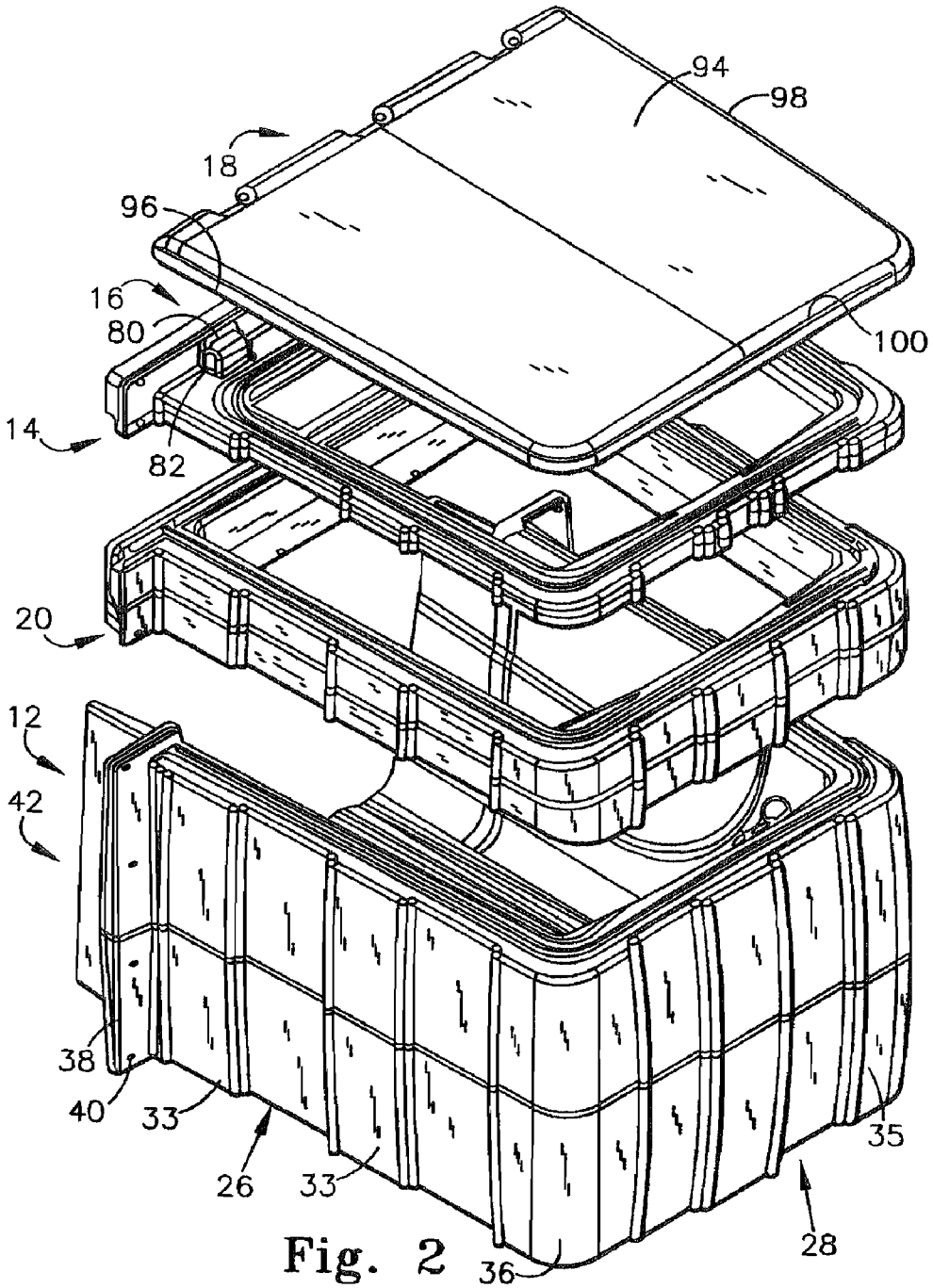
FIG. 2 is an exploded perspective view of the present invention.

The crawl space access system 10 of the present invention is shown in FIG. 1 as being installed in a wall 2 of a house. The wall 2 includes a crawl space wall portion 4 and a first story wall portion 6. The crawl space wall portion 4 is usually made from concrete block or poured concrete, and is disposed in an excavated pit, so that the top 5 of the crawl space wall 4 is disposed at a level generally equal within about one foot (0.3 meters) from the grade G of the land adjacent to the wall 4. The first story of-the-building wall 6 extends upwardly from the crawl space wall 4 and is disposed generally above the grade G of the surrounding land. The crawl space wall includes an opening 7 of standard size, which is typically between about 26 to 48 inches (0.6 metres to 1.22 metres) in width and between about 20 and 30 inches (0.5 metres to 0.76 metres) in height.

The crawl space access device 10 is sized and designed to be partially received within the opening 7 of the crawl space wall 4, so that, in most cases, the device 10 will be predominately positioned below grade G, with only less than a foot (0.6 metres), and preferably six inches (0.3 metres) or less of the device being disposed above the grade G.

The crawl space device 10 shown in FIGS. 1-6 includes a base portion 12, and a cap portion 14. The cap portion 14 includes a cap ring 16 that can be coupled to the base portion 12, and a lid member 18 that is hingedly coupled to the cap ring 16 for movement between an open position and a closed position. The upper portion of the cap ring 11 and the lid 18 are preferably disposed above grade G. Placing the cap ring 11 above grade helps to prevent laterally flowing water from entering the interior of the tub of the device.

A spacer member 20 can be inserted between the cap ring 16 and the base member 12 to raise the effective height of the base member 12. Preferably, the spacer member 20 has a height of 6 inches (0.3 metres), and is designed so that the user has the option of stacking several spacer members 20 on top of each other to thereby enable the crawl space access system 10 to reach the desired grade elevation G of the land surrounding the crawl space access system 10 and house, so that the top of the cap ring 16 affixed to the uppermost spacer 20 will be disposed a few inches above grade G.

Figure 3:
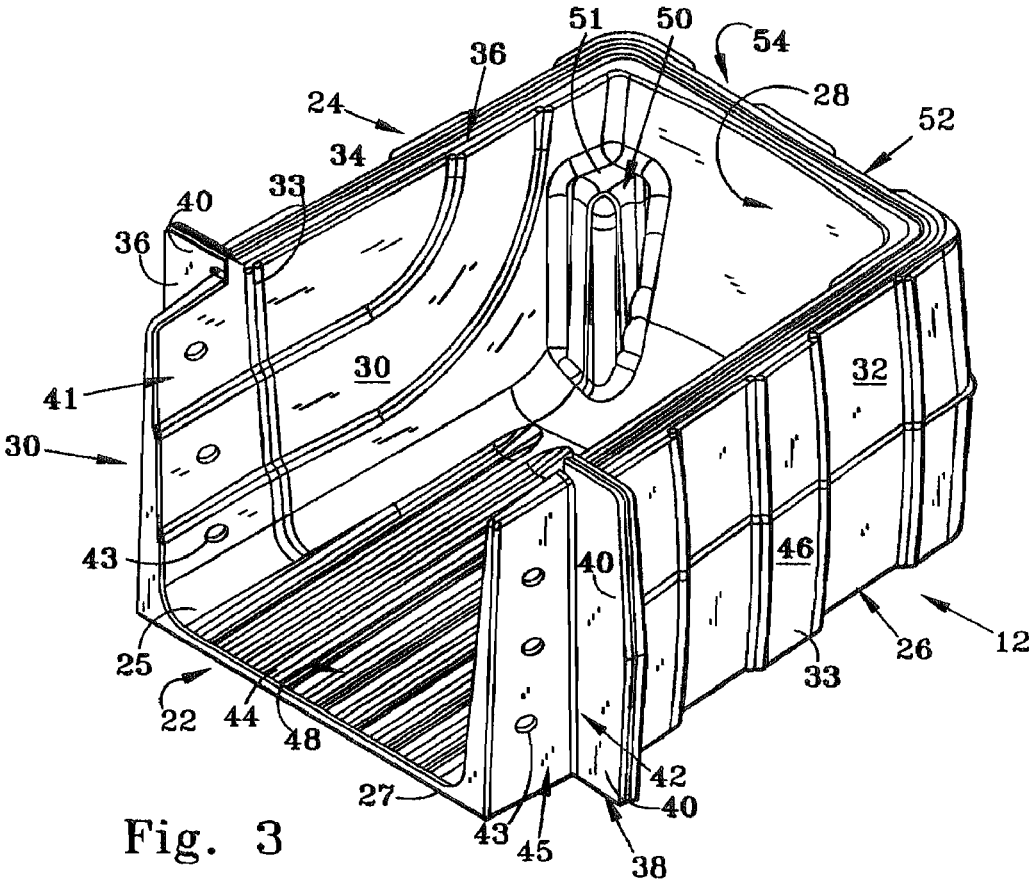
FIG. 3 is a perspective view of the base or tub member of the present invention.
Figure 4:
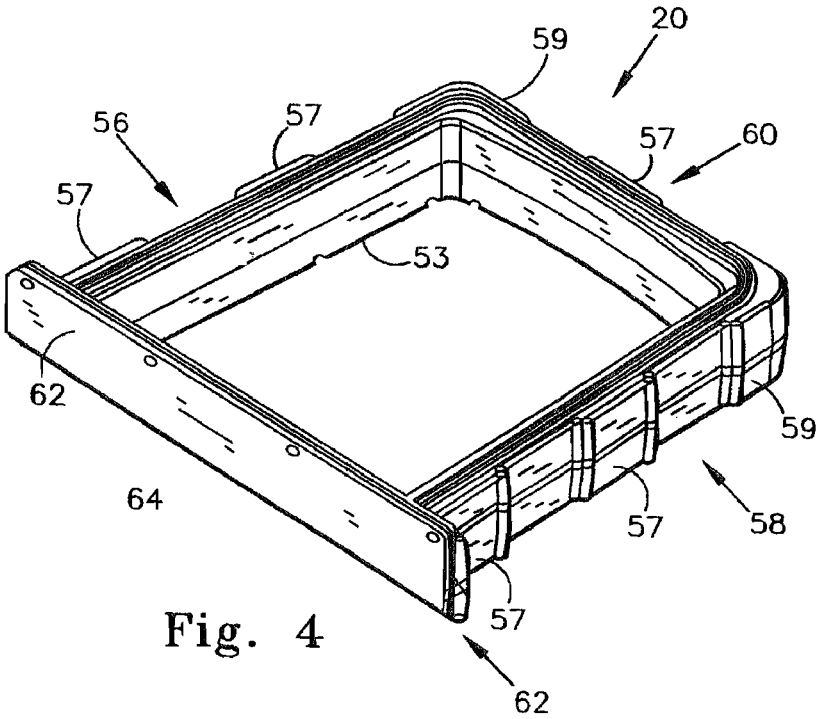
FIG. 4 is a perspective view of an expander/spacer component of the present invention.

The base member 12 is best shown in FIG. 3. As alluded to above, the base member 12 generally has a shape similar to an open-ended bathtub. The base member 12 includes a base wall or floor 22. A first side wall member 24 extends perpendicular to the floor 22, and is disposed along one edge of the floor member 22. A second side wall member 26 is disposed adjacent to the second edge of the floor 22, and extends perpendicular thereto. An end member 28 extends perpendicular to the floor 22, and is disposed at one end of the floor. The first and second side member 24, 26 and end member 28 together form the side wall portion of the crawl space base member 12.

The end 29 that is in an opposed relation to the first end member 28 is generally left open.

Preferably, the entire base member 12 is unitarily constructed from a plastic material, and is preferably formed through a rotational molding process. Each of the first and second side walls 24, 26 and first end member 28 portions of the base 12 are preferably double-walled, having an interior wall surface 30 and an exterior wall surface 32. A hollow cavity exists between the interior and exterior walls. The floor of the base member 12 may be formed to be a solid plastic for strength and rigidity, or else comprise a first and second walls 25, 27 that are placed closely adjacent to each other.

The interior 30 and exterior 32 wall surfaces of the side wall portions are separated to define a hollow cavity therebetween. Although the hollow cavity can be left empty, a ballasting material, such as sand can be placed in the hollow cavity to add to the weight of the device 12, thereby increasing the resistance of the device to rise out of its hole. Alternately, an insulation material such as fiberglass can be placed in the hollow cavity.

It should be noted that the interior side wall surfaces 30 are generally planar, but may include one or more rib portions 33 that extend out of the primary plane of the wall to enhance structural rigidity. The exterior wall surface 33 includes a series of generally vertically extending rib portions to also improve the structural rigidity of the base member 12. The ribs also help to better anchor the base member 12 in the crawl space hole in which it resides.

Two of the ribs comprise corner ribs 35 disposed at the intersection of the side walls 24, 26 and the end member 28.

A pair of perpendicular side flanges 36,38 extend perpendicularly outwardly from each of the first and second side walls 24, 26. These side flange members are provided with a series of apertures 40.

The first and second side wall 24, 26 and floor 22 each include an interiorly disposed portion 24A, 26A, 22A respectively that is disposed relatively interiorly toward the interior of the crawl space and, when assembled, is disposed interiorly of the exterior surface of the crawl space wall 4. The interiorly disposed portion 24A, 26A, 22A extends interiorly from the side flanges 36, 38 of the side wall include aperture 41 through which bolts can pass through fixedly coupling devices 10 to below grade crawl space wall 4.

As best shown in FIG. 1, when the base 12 is inserted into an opening 7 in a crawl space wall 4, the first and second side flanges 36, 38 will be placed adjacent to an exterior surface of the crawl space wall 4 so that fasteners, such as bolts or screws, can be inserted through the apertures 40 of the side flanges 36,38 and bolted into, screwed into, or otherwise attached to the crawl space wall 4, to secure the base unit 12, and hence the crawl wall access system 10 to the wall 4 of the crawl space. Further, bolts may pass through apertures 43 formed in the end portions 41, 45 of the side walls 24, 26 that are placed adjacent to the side surface of the crawl space openings 42, to further secure the base member 12 to the crawl space wall 4. Additionally, the placement of the first 36 and second 38 flanges against the exterior surface of the crawl space wall 4 helps to facilitate the proper positioning of the base member 12 vis-a-vis the below grade wall 4 and below grade opening in the wall 4.

A plurality of reinforcing ribs 33,35 are provided to extend generally vertically around the exterior of the side wall 24, 26 of the base member 12. The ribs 33, 35 provide extra strength and rigidity to the base member. Further, a series of ridges 44 can also extend along the floor portion 22 to provide structural rigidity thereto, and also provide a better gripping surface for someone walking upon the floor 22. As the floor is made of an interior and exterior layer of plastic, with usually some separation there between to define a hollow cavity, the ridges are likely to help prevent the upper layer of plastic from bending or "oil canning" when weight is placed on it.

A pair of hand-hold members 50 are disposed in the interior of the base member 12. One hand hold member 50 is disposed adjacent to each of the corners where the first side wall 24 meets the first end member 28, and where the second side wall 26 meets the second end member 28. These hand-hold members 50 preferably comprise raised platforms having a horizontally disposed surface 51. These hand-hold members 50 help one to crawl out of the base member 12. Because of the size of the height (20-30 inches, 0.5 to 0.76 metres) of the crawl space opening 42, one typically enters and exits the crawl space by placing one's buttocks on the floor 22 of the base unit 12, and then sliding feet first, and supinely, into the crawl space. As such, one exiting the crawl space access device is likely to be in a sitting position with his/her buttocks on the floor 22 of the device and his/her back against the interior surface of the end wall portion 28.

When the user is in such a sitting position, the position of the hand hold members 50 enables the user to place the palms of his hands on these horizontal surfaces 51, to thereby help him raise himself to a standing position to thereby lift himself out of the interior of the tub-like base member 12, and hence lift him up to the ground surface G surrounding the crawl space access member 10.

A ridge member 52 extends along the upper surface of the side wall portions 24, 26 and end portion 28. This ridge 52 is sized and configured to be received by a corresponding groove member 54 formed in the underside of either the cap ring member 16, or a spacer member 20.

If one wishes to impart additional height to the base member 12, so that the top of the crawl space access system 10 is equal or above the grade G of the land adjacent to the crawl space access member 10, one inserts one or more spacer member 20 (FIG. 4), such that the groove (not shown) formed on the lower surface 53 of the spacer member 20 becomes engaged with the ridge 52 (FIG. 3) that is formed on the upper surface of the base member 12.

The spacer member 20 also includes first and second side walls 56, 58, and an end wall 60 that are generally similar in size and configuration to the side 24, 26 and end 28 walls of the base unit 12, and which may also include a series of reinforcing ribs 57 and corner ribs 59. Additionally, a pair of flange members 62 extend outwardly from the side walls adjacent to the interior end and that are formed as a part of the interior end cross member 64.

However, the spacer member 20 does not include side wall portions that extend interiorly into the opening 42 of the crawl space, as no opening would normally exist at the position occupied by the spacer 20. Further, the spacer member 20 includes a cross member 64 that extends at the second end of the first and second side members 56, 58, to provide a rigid, ring-like structure for the spacer 20. As alluded to above, the spacer 20 is preferably designed so that a plurality of spacers 20 can be used together, by stacking the individual spacer members on top of each other.

At present, the Applicant intends to employ spacer members 20 having a six inch (0.15 metres) height. As such, if the user desires to increase the height of the vertical walls of the crawl space access system 10 by 18 inches (0.46 metres), in order to get the top of the crawl space access system 10 up to grade G, the user can accomplish this by stacking three, six inch (0.15 metre) tall spacer members 20 on top of each other so that the circumferential ridge 65 formed on the upper surface of a relatively lower spacer 20 is received within the circumferential groove of the spacer 20 above it.

Figure 5:
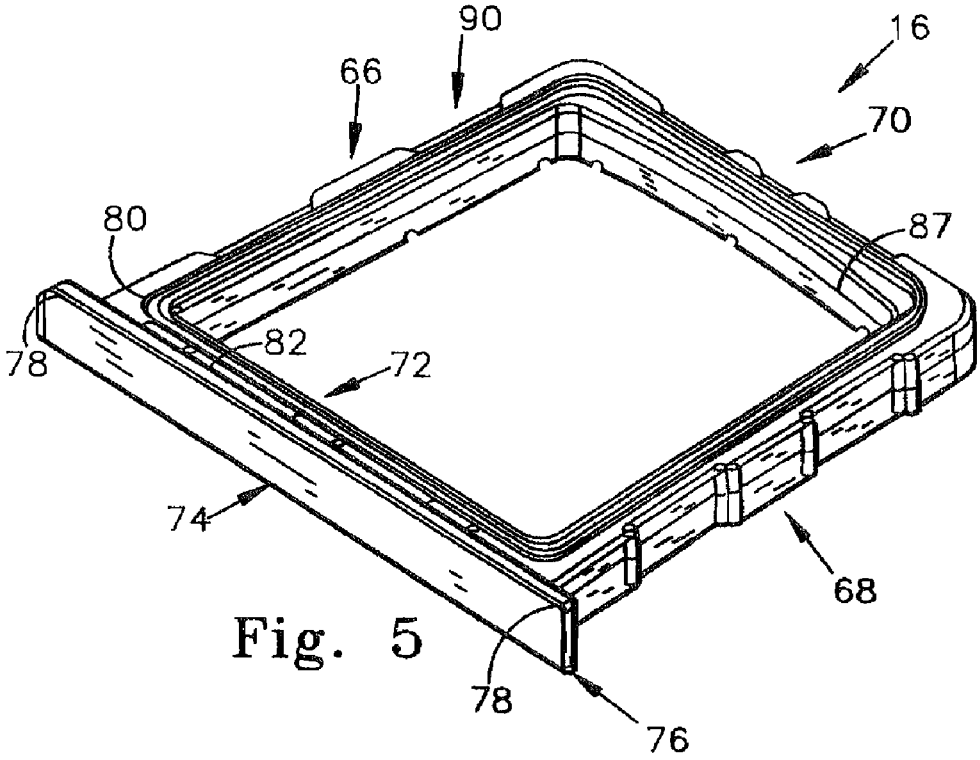
FIG. 5 is a perspective view of a top cap assembly of the present invention (with the top cap removed for clarity)
Figure 6:
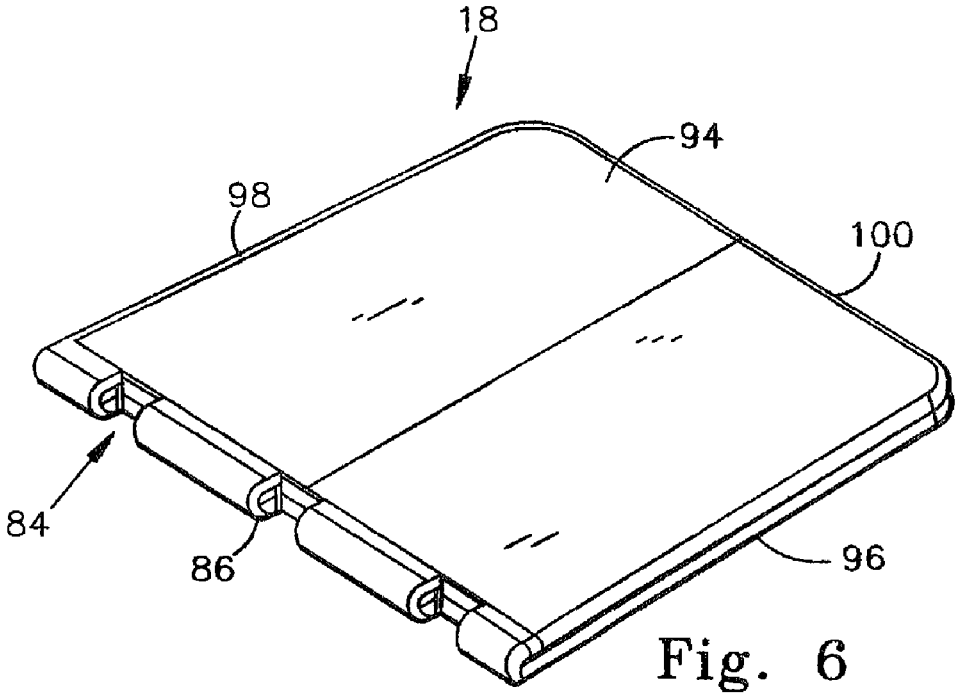
FIG. 6 is a perspective view of the top cap of the present invention.

The next member that is stacked on top of the unit is the cap ring member 16 that is best shown in FIG. 5. The cap ring member 16 is shaped generally similarly to the spacer member 20, insofar as it includes the pair of side walls 66, 68, and first and second end walls 70, 72. The second end wall 72 can include a facial member 74 that is placeable up against the exterior wall of the crawl space.

The cap ring member 16, like the spacer member 20, can also include side flanges 76 having apertures 78 through which bolts can pass, for securing the spacer members 20 and cap ring members 16 to the exterior wall of the crawl space 10.

A series of hinge members 80 are disposed on the upper surface of the cap ring member 16 adjacent to the crawl space wall-engaging facia. The hinge members 80 of the cap ring member 16 are sized and positioned to mate with corresponding hinge members 84 of the cap member 18. When so mated, a rigid rod (such as a metal, plastic or wood rod) can be inserted through a series of co-linear, aligned apertures 82 that extend through the interior of the hinge members 80 of the cap ring member 16, and similar aligned, co-linear apertures 86 extending through the interior of the hinge members of the cap 18, to hingedly couple the cap 18 to the cap ring member 16. When so hingedly coupled, the cap can move between a closed position, where the cap covers the opening of the ring, and an open position, that uncovers the opening 87 of the ring 16 to allow ingress and egress to the interior of the tub-like base member 12 and hence the crawl space.

The spacing between the hinged members 84, 80 respectively of the cap member 18 and the ring member 16 should be relatively tight, to provide a frictional engagement therebetween. This frictional engagement helps to hold the cap 18 in the upright (open) position when so desired. Alternately, a stick-like prop up rod, or a pneumatic piston arrangement (not shown) can be employed to hold up the cap 18 in the open position.

The cap member 18 includes a generally planar top portion 94 and a circumferential flange that includes a first side flange portion 96, a second side flange portion 98, and an end side flange portion 100. The flange portions 96, 98, 100 extend generally perpendicularly to the top portion 94 to form a downwardly extending ring which extends adjacent to the first and second side edges, and the end edge of the top portion 94. The cap member 18 is sized and configured to fit over the cap ring member 16. The cap member 18 can be constructed similarly to a hinged trash can lid, but preferably is stronger to enable it to hold more weight without deforming.

Figure 13:
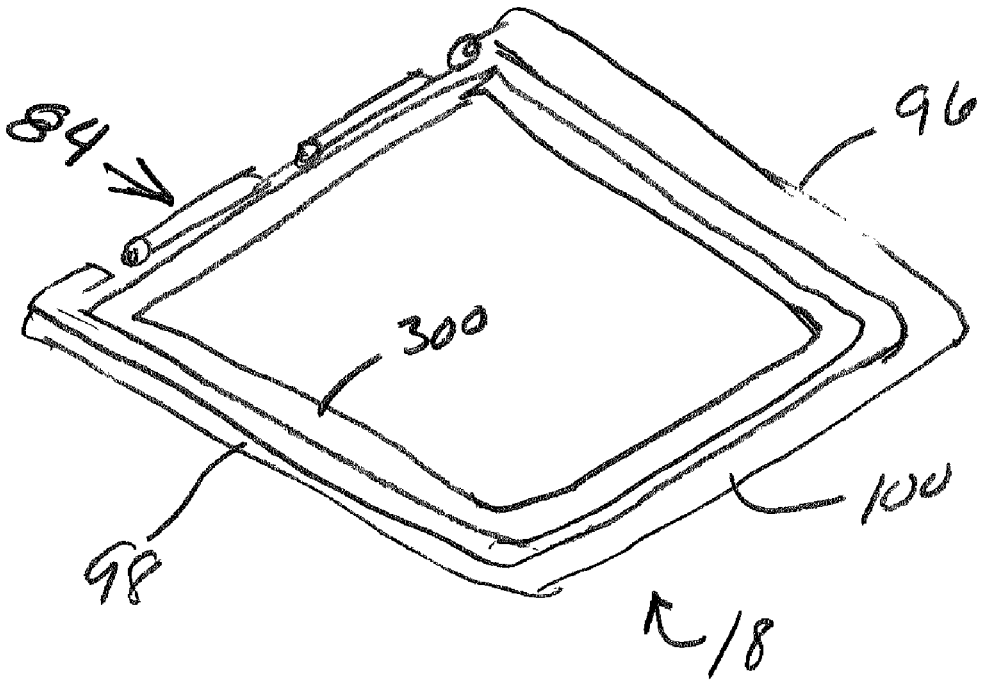
FIG. 13 is a perspective underside view of an alternate embodiment lid of the device of the present invention containing a gasket member engagable with the cap ring.

The cap ring member 16 also includes a ridge 90 on its upper surface, that is designed to be mated to a groove on the underside surface of the cap ring for the cap member 18, to provide a sealing engagement therebetween. The sealing engagement helps to prevent water and moisture from entering into the interior of the crawl space access system. As best shown in FIG. 13, a ring-shaped perimetral gasket 300 can be adhesively attached to the underside surface 302 of the cap lid 18. The engagement of the gasket with the upper surface of the cap ring 16 helps to provide a water-tight-seal for retarding or preventing the inflow of moisture into the interior of the base member 12. Preferably, the gasket 300 is made from an adhesive backed 115.4 inch (2.93 metres) long strip of gasket material, which is adhesively attached to the underside surface of the cap 18 in a ring-like configuration. The gasket 300 is preferably made from a neoprene/vinyllbuna-n foam rubber strip that is about 0.125 inches (0.3175 cm) thick, and about 0.75 inches (1.9 cm) wide.

It will be noted that the gasket 300 runs parallel to, and is disposed interiorly of the flange portions 96, 98, 100, and the hinge 84 of the cap member 18.

Additionally, a sealant can be placed between the various layers, such as the top of the base member 12 and the underside of the spacer member 20, and the top of the spacer member 20 and the underside of the cap ring member 16. The sealant can be provided first to glue the members together to hold the members in a fixedly engaged relationship and also to help retard the ingress and egress of moisture in the spaces between the components. A commercially available silicon sealant can be used for this purpose.

The device 10 so created by the present invention is believed to provide a cleaner, dryer, more durable and more cost-effective crawl space access system than those currently known. The device will not rust or rot since it is constructed almost entirely from plastic.

Important to the builder, it can be installed relatively inexpensively. The Applicant believes that the device should be able to be installed in 30-45 minutes once the pit is dug for this unit 10.

Also, the lid 18 will help to serve as a safety device. The existence of the lid 18, when normally in the down position, will reduce the likelihood of someone falling into the depression created by the interior of the base member 12 of the crawl space entry device 10. The lid 18 should preferably be designed to be strong enough to bear enough weight so that the lid 18 will not collapse or deform significantly if one of normal size and weight falls on the lid 18, or steps across the lid 18.

Additionally, the lid 18 can be designed with a locking mechanism, so that the lid 18 can be locked to the cap ring member 16, to maintain the lid 18 in the down or closed position, and to prevent the lid 18 from being lifted and kept open. The locking mechanism can comprise a hasp and plate arrangement for accepting a traditional padlock, or can comprise a customized device designed especially for the unit 10.

It will also be appreciated that some users will prefer a locking mechanism whose primary purpose is to serve as a latch to maintain the engagement of the lid 18 with the cap ring 18, even though no third party deterrent lock mechanism may be a part of the latch. Others, however, may wish to use a latch and lock mechanism which includes both a latch to maintain engagement between the cap 18 and ring 16; and a lock mechanism (e.g. padlock, cylinder lock) that serves as a deterrent to the cap 18 being opened by unauthorized persons.

The device 10 provided is also more aesthetically pleasing than currently known devices. Because it will not rust, it will not take on the ugly rust characteristics of rusted out metal.

Preferably, the components of the device 10 will be dyed to an appropriate color. Although it is envisioned that most persons will want the device to be dyed a greenish color to blend in with the grass and/or plants surrounding the crawl space access system 10, it could also be color keyed into another color. For example, the color of the device could be chosen to match the paint on the side of the particular house in which it is installed. Alternately, an applique could be placed onto the lid that would coordinate with the wood, stone, brick or siding of the house. As another alternative, the device could be provided in a bright color (e.g. white, rocket red, safety orange, saturn yellow, etc.) as a safety measure to make its existence more readily discernable.

An alternate embodiment crawl space access device 210 is shown in FIGS. 7-12. Crawl space access device 210 is generally similar to crawl space access 10, except for the fact that crawl space access device 210 includes a sump hole cover 231 that is removably attachable to the floor 222 of the base 212 of the crawl space access device.

It has been found by the Applicant that one problem that affects owners of houses with crawl spaces, is that the crawl spaces can become filled with water. To remove water from the interior of the crawl space, it is typical to place a sump pump in the crawl space. As the floor of the crawl space is often comprised of gravel, the sump pump is often buried in the gravel within the crawl space. As can be appreciated, this makes it difficult to gain access to the sump pump within the crawl space.

In some situations, it is possible to drain water from the basement by placing the sump pump exteriorly of the wall. This exterior placement of the sump pump is possible due to the fact that gravel or some other similar material is often placed on the exterior of the wall to surround the house. Many times the gravel placed exteriorly of the wall is in fluid contact with the gravel that is disposed interiorly within the crawl space. As such, the existence of a sump pump that can pull water from the gravel disposed exteriorly of the crawl space wall 4 will also drain water from the gravel contained within the interior of the crawl space wall 4.

In other situations, water cannot travel through the gravel between the interior and exterior of the crawl space. However, situations arise wherein water exterior of the crawl space collects in the gravel area placed adjacent to the exterior wall of the crawl space. This collected water also needs to be removed in order to prevent the water from infiltrating into the crawl space.

It has been found by the Applicant that a good place to position such an exteriorly disposed sump pump is under the crawl space access pit. By providing a crawl space access that includes a sump hole cover, the user can gain access to this exteriorly disposed sump pump that is contained within a sump hole that is disposed at the bottom of the crawl space pit underneath the crawl space access device.

Figure 7:
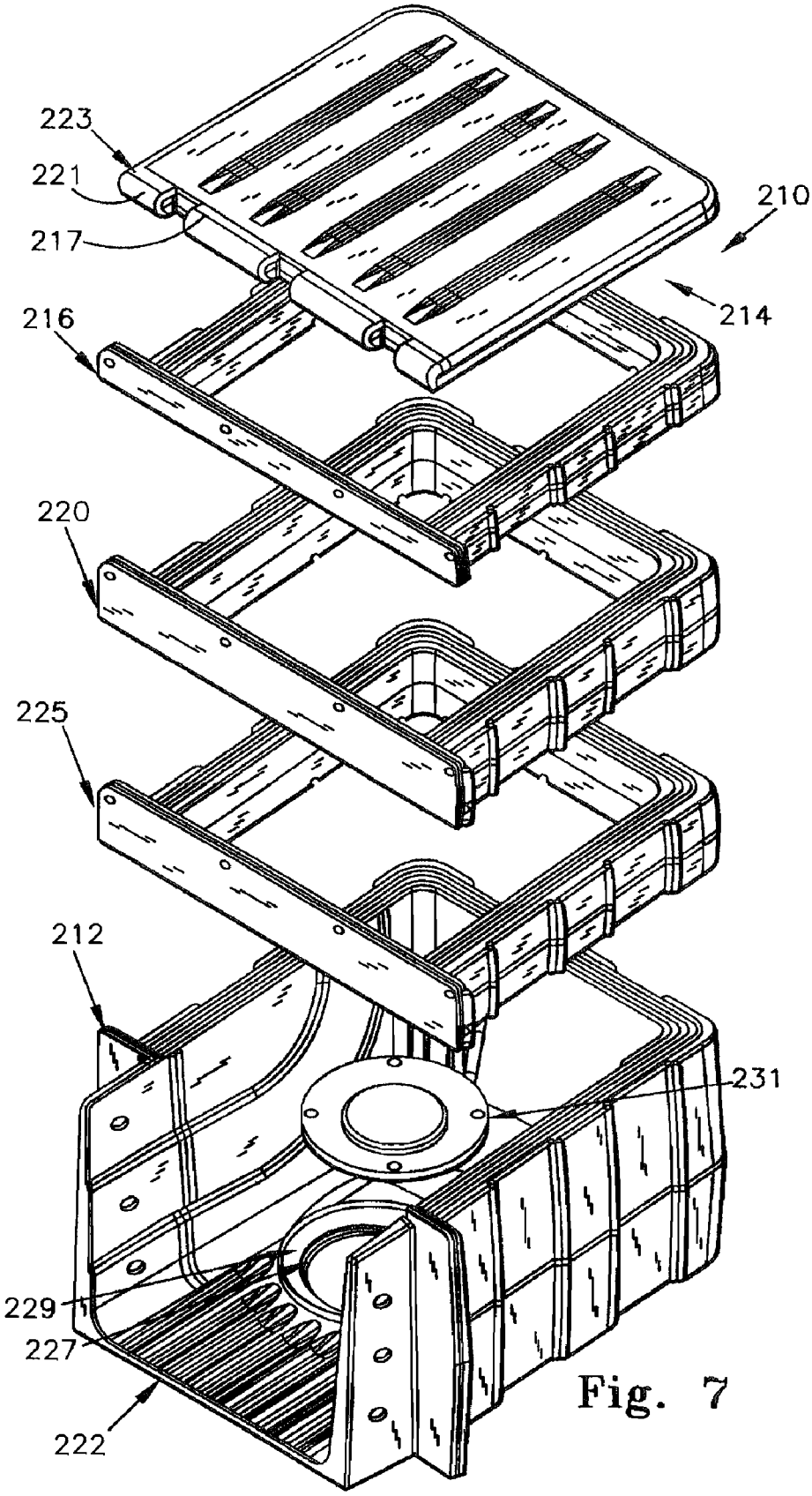
FIG. 7 is a perspective, exploded view of a first alternate embodiment crawl space access device of the present invention that includes a removable sump hole cover.
Figure 8:
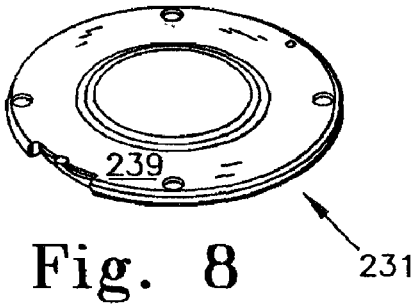
FIG. 8 is a perspective view of the sump hole cover of the present invention.
Figure 9:
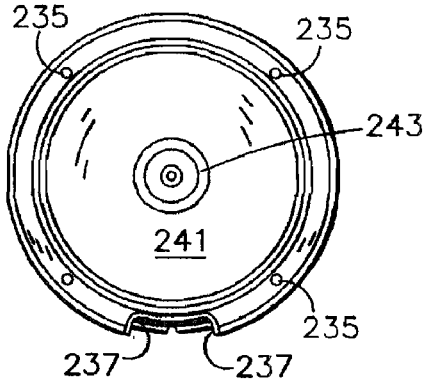
FIG. 9 is a bottom plan view of the sump hole cover of the present invention.
Figure 10:
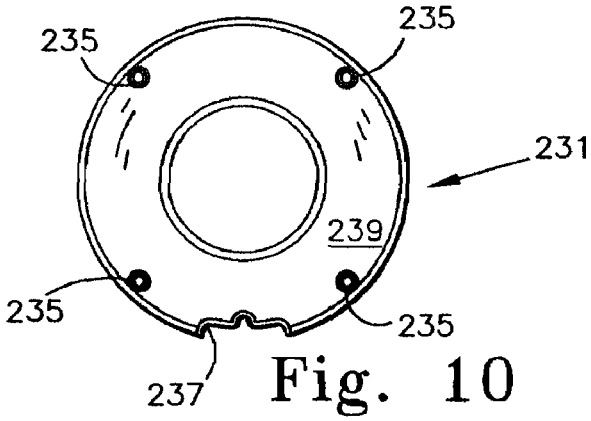
FIG. 10 is a top plan view of the sump hole cover of the present invention.
Figure 11:
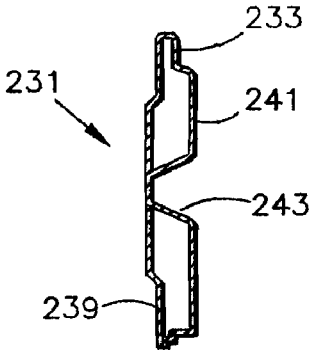
FIG. 11 is a sectional view taken along lines A-A of FIG. 10.
Figure 12:
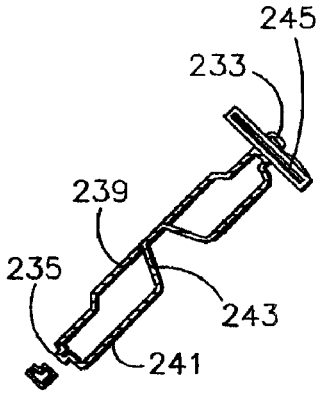
FIG. 12 is a sectional view taken along lines B-B of FIG. 10.

As best shown in FIG. 7, the alternate embodiment crawl space access device includes a base portion 212 and a cap portion 214. The cap portion 214 is comprised a cap ring 216 and a lid member 218 that are generally identical to the cap ring 16 and lid member 18 that is shown in FIG. 1. A hinge mechanism 223 is provided for hingedly coupling the lid member 218 to the cap ring 216, so that the lid member 218 can move between a closed position and an open position. The hinge mechanism 223 includes a generally linear, cylindrical hinge rod 217 that can be extended through a series of aligned hinge tubes 221 that are formed in the lid 218.

First and second spacer members 220, 225, that are generally similar to spacer member 220 shown in FIG. 1 can also be provided to increase the vertical height of the crawl space access device 210.

The base portion 212 is generally similar to base portion 12, except that a removable sump hole cover 231 is provided for being removably coupled to a sump hole aperture 227 formed in the floor 222 of the base portion 212. Sump hole aperture 227 is generally circular in configuration, and includes a perimetral lip 229. The sump hole cover 231 is also preferably formed out of plastic, and includes a perimetral flange 233. The underside of the perimetral flange 233 is sized and positioned for engaging the perimetrallip 229 of the crawl space aperture 227.

The sump hole cover 231 includes four bolt hole apertures 235 that are formed in the flange 233. One or more bolts, such as bolt 245 (FIG. 11) can pass through the apertures 235 for fixedly, but removably coupling the sump hole cover 231 to the perimetrallip 227, and hence the floor 222 of the base member 212.

The sump hole cover 231 is preferably formed from a rotational molding, or blow-molding process, and includes an upper surface 239 and a lower surface 241. Upper surface 239 is generally planar in configuration. Bottom surface 241 is also generally planar, but includes a central recess portion 243 for providing additional structural rigidity to the sump hole cover 231. It will be appreciated that such additional structural rigidity is useful for the device, as the device will often bear the weight of the user who may be either standing or sitting on the sump hole cover 231, when entering or leaving the crawl space.

A notch portion 237 is formed in the perimetral flange 233 of the sump hole cover 231. The notched out portion 237 is matable with a mirror image protrusion portion (not shown) and is formed in the perimetrallip 229, to provide a proper and appropriate rotational alignment of the sump hole cover 231 vis-a-vis the aperture 227. This rotational alignment facilitates the user's replacement of the sump hole cover 231 into engagement with the aperture 227, by enabling the sump hole cover to fit in only one position that, preferably is a position wherein the bolt holes 235 of the sump hole cover 231 align with respective mating apertures in the perimetrallip 229, to thereby permit the bolts 245 to pass through the apertures 235 of the sump hole covers, and into the apertures of the lip 229, to thereby permit the bolts 245 to fixedly couple the sump hole cover 231 to the floor 222 of the base member 212.

Although the device has been described with reference to preferred embodiments, it is to be understood that the scope of the invention is not to be defined to the embodiment shown, but rather, to the greatest extent permissible by law, and the prior art.

What is claimed is:

1. A crawl space access device for facilitating a user's ingress into and egress from a crawl space, the device being placeable in a below grade level crawl space entry pit, and mating with a below grade ingress opening in a building wall, the below grade ingress opening being defined by horizontally disposed lower and upper surfaces and vertically disposed first and second side surfaces, the crawl space access device comprising a tub shaped body member having a floor portion, and a sidewall including a first side panel member, a second side panel member, a first end panel and a second end panel, the floor portion being restable on a horizontal surface of the pit, the floor portion having a lower surface and an upper surface, the upper surface being disposed at a level at least as high as the lower surface of the ingress opening, the floor portion being sized to permit a user to sit on the upper surface of the floor portion prior to entering a crawl space, the tub shaped body having a first end disposed adjacent the first end panel, a second end disposed adjacent to the second end panel and a middle portion disposed between the first and second end panels of the tub portion, the second end panel including a side wall opening mateable with the below grade ingress opening, wherein the second end of the tub shaped body has a cross-sectional area generally similar to the cross sectional area of the middle portion of the tub shaped body the sidewall and floor defining a body member interior, the body member including an edge defining a upwardly facing upper opening disposed in a plane generally perpendicular to the plane of the side wall opening, wherein a user standing at or above grade can move generally vertically through the upper opening into the tub interior and generally horizontally through the side wall opening into a crawl space.

2. The crawl space access device of claim 1 wherein the second side panel member has a first end portion and second end portion, the second side panel member is disposed in a plane generally parallel with a plane in which the first side panel member is disposed, and the first end panel is disposed in a plane generally perpendicular to the planes in which the first and second side panel members are disposed.

3. The crawl space access device of claim 2 wherein the second end portion of the first side panel member and the second end portion of the second side member panel define the side wall opening therebetween.

4. The crawl space access device of claim 1 wherein the floor portion includes a first end portion coupled to, and disposed generally perpendicularly to the first end panel, and a second end portion, the second end portion being inserted into the ingress opening and placeable in a parallel plane with, and against the lower surface of the ingress opening to overlay the lower surface of the ingress opening, when the device is attached to a building.

5. The crawl space access device of claim 1 wherein the first side panel member has a first end portion and a second end portion, wherein the the second end portion of the first side panel member extends through the ingress opening so that when the device is attached to a building, further comprising a first flange member disposed between the first and second end portions of the first side panel member and extending in a plane generally perpendicular to the first side panel member.

6. The crawl space access device of claim 1 wherein the base member is formed from a plastic material to include an interior plastic layer, an exterior plastic layer and a hollow cavity between the interior and exterior plastic layer, further comprising at least one of a ballast material and an insulation material inserted in the hollow cavity.

7. The crawl space access device of claim 1 wherein the floor portion includes an access opening, and a cover member removably attachable to the floor portion for covering and plugging the access opening.

8. The crawl space access device of claim 7 wherein the cover member and aperture are sized to permit a sump pump to pass through the access opening to permit a user to gain access to a sump pump installed below the floor portion.

9. The crawl space access device of claim 1 wherein the first side panel member has a first end portion and a second end portion, the second side panel member has a first end portion and a second end portion, the second side panel member is disposed in a plane generally parallel with a plane in which the first side panel member is disposed, and the first end panel is disposed in a plane generally perpendicular to the planes in which the first and second side panel are disposed, wherein the second end portion of the first side panel member and the second end portion of the second side panel member are insertable into, to extend through the below grade opening of the building wall when the device is attached to a building.

10. The crawl space access device of claim 1 wherein the body member has an open top, further comprising a cap member, the cap member including a lid for covering the open top and for preventing water and moisture from entering into the tub interior, the lid being movable between an open and closed position.

11. The crawl space access device of claim 10 wherein the side wall portion includes an upper edge, the cap member comprises a ring having a lower edge capable of being in contact with the top edge of the wall portion, and an upper edge engageable with the lid when the lid is in the closed position.

12. The crawl space access device of claim 10 wherein the lid, when the device is attached to a building, includes a first end disposed above grade relatively distally of the building wall, and a second end disposed above grade relatively proximally to the higher elevation than the first end of the lid, to direct rainwater falling on the lid in a direction away from the building wall.

13. The crawl space access device of claim 12 further comprising a ring shaped spacer member placeable on an upper surface of the side wall portion for raising the effective height of the side wall portion.

14. The crawl space access device of claim 13 wherein the spacer member comprises a plurality of spacer members, the plurality of spacer members being engageable with each other and with the side wall portion through a tongue and groove arrangement.

15. A crawl space access device for facilitating a user's ingress into and egress from a crawl space, the device being placeable in a below grade level crawl space entry pit, and mateable with a below grade ingress opening in a building wall, the crawl space access device comprising a tub shaped body member having a floor portion and a sidewall disposed generally perpendicular to the floor portion and including a first side panel member, a second side panel member, a first end panel and a side wall opening mateable with the below grade ingress opening, the first side panel member having a first end portion and a second end portion, the second side panel member having a first end portion and second end portion, the floor portion being sized to permit a user to sit on the upper surface of the floor portion prior to entering a crawl space, the side wall and floor portion defining a body member interior, the body member including an edge defining a upwardly facing upper opening disposed in a plane generally perpendicular to the plane of the side wall opening, a first flange member disposed between the first and second end portions of the first side panel member and extending in a plane generally perpendicular to the first side panel member, the first flange member including a surface placeable against a surface of the building wall adjacent to the below grade opening when the device is attached to a building, wherein a user standing at or above grade can move generally vertically through the upper opening into the tub interior and generally horizontally through the side wall opening into a crawl space.

16. The crawl space access device of claim 15 wherein floor portion includes a first end disposed adjacent to the first end portion, and a second end defining at least a portion of the side wall opening, wherein the floor portion is substantially planar between the first end and the second end.

17. The crawl space access device of claim 16 wherein the second end portion of at least one of the first and second side panels includes at least one aperture, the aperture capable of receiving a fastener there through for fixedly coupling the at least one of the first and second side panels to the building wall when the device is attached to a building.

18. The crawl space access device of claim 15 further comprising at least one fastener for fixedly coupling the second end portion of at least one of the first and second side panel members to the building wall when the device is attached to a building.

19. The crawl space access device of claim 15 further comprising a second flange member disposed between the first and second end portions of the second side panel member, the first and second flange members being disposed generally coplanarly.

20. A crawl space system for a building comprising:

a crawl space including a crawl space wall wherein at least a portion of the wall is below ground level, the wall including a below grade ingress opening defined by horizontally disposed lower and upper surfaces and vertically disposed first and second side surfaces, a below grade level crawl space entry pit disposed adjacent to the below grade ingress opening, and a crawl space access device for facilitating a user's ingress into and egress from the crawl space through the below grade ingress opening, the access device being disposed in the below grade level crawl space entry pit, and coupled to the building wall, the crawl space access device comprising a tub shaped body member having a floor portion disposed on a horizontal surface of the pit, the floor portion having a lower surface and an upper surface, the upper surface being disposed at a level at least as high as the lower surface of the ingress opening, the floor portion being sized to permit a user to sit on the upper surface of the floor portion prior to entering the crawl space, and a side wall portion extending generally perpendicular to the floor portion, the side wall portion including a side wall opening mated with the below grade ingress opening, the sidewall and floor defining a body member interior, the body member including an edge defining a upwardly facing upper opening disposed in a plane generally perpendicular to the plane of the side wall opening, wherein a user standing at or above grade can move generally vertically through the upper opening into the tub interior and generally horizontally through the side wall opening and below grade ingress opening, and into the crawl space.

21. The crawl space access device of claim 20 wherein the floor portion has a first end and a second end, and is generally planar between the first and second end.

22. The crawl space access device of claim 20 wherein the floor portion includes a first end portion coupled to, and disposed generally perpendicularly to the first end panel, and a second end portion including a second end of the floor portion, the second end portion being inserted into the ingress opening and disposed in a plane parallel to the lower surface of the ingress opening to overlay the lower surface of the ingress opening.

* * * * *